US005715924A

United States Patent [19]

Takemoto et al.

[11] Patent Number: 5,715,924

[45] Date of Patent: Feb. 10, 1998

[54] GAME PLAY MEDIA LENDING MACHINE, FOR WHICH BANK NOTES CAN BE USED

[75] Inventors: Takatoshi Takemoto; Kazunari Kawashima, both of Tokyo, Japan

[73] Assignee: Kabushiki Kaisha Ace Denken, Tokyo, Japan

[21] Appl. No.: 553,251

[22] PCT Filed: May 13, 1994

[86] PCT No.: PCT/JP94/00776

§ 371 Date: Nov. 13, 1995

§ 102(e) Date: Nov. 13, 1995

[87] PCT Pub. No.: WO94/26369

PCT Pub. Date: Nov. 24, 1994

[30] Foreign Application Priority Data

May 13, 1993 [JP] Japan ..... 5-111802

[51] Int. Cl.[6] ..... G07F 7/04; G07F 17/38

[52] U.S. Cl. ..... 194/206; 271/3.12; 271/220

[58] Field of Search ..... 194/206, 207, 194/217, 218; 209/534; 271/3.12, 161, 209, 220

[56] References Cited

U.S. PATENT DOCUMENTS

| | | | |
|---|---|---|---|
| 4,499,982 | 2/1985 | Sugimoto et al. | 194/217 |
| 4,884,671 | 12/1989 | Gardellini | 194/207 |
| 5,271,613 | 12/1993 | Hain | 271/3.12 |
| 5,332,076 | 7/1994 | Ziegert | 194/217 |
| 5,417,331 | 5/1995 | Takemoto et al. | 209/682 |

FOREIGN PATENT DOCUMENTS

| | | | |
|---|---|---|---|
| 222715 | 5/1987 | European Pat. Off. | 271/220 |
| 4-144583 | 5/1992 | Japan . | |
| 5-35964 | 2/1993 | Japan . | |

*Primary Examiner*—F. J. Bartuska
*Attorney, Agent, or Firm*—Seed and Berry LLP

[57] ABSTRACT

A bank note input from the outside is accepted for lending game play media. If change is to be given, a bank note is dispensed as the change. A bank note validation section (20*a*) takes in an input bank note, determines at least the denomination of the bank note, and outputs amount information. A bank note return section (20*b*) stores the bank note if it is a bank note that can be used for change, and is responsive to a change paying out command for dispensing a necessary number of bank notes as change to the outside, using the stored bank notes. A lending controller (70) uses a dispensing controller (81) for inputting the amount information and is responsive to a lending command for outputting a command for dispensing game play media in a given dispensing unit. The lending controller uses a calculation circuit (82) for subtracting an amount corresponding to the dispensing unit from an amount indicated by the amount information to find the remaining amount. A return controller (83) outputs a change paying out command to the bank note return section if the remaining amount is not zero. A game play media dispenser (60) is responsive to a dispensing command for dispensing a predetermined number of game play media.

15 Claims, 9 Drawing Sheets

241
241a
241c
241b
DRIVE CIRCUIT
242
241a
242c
242b
DRIVE CIRCUIT
211
211a
211c
211b
DRIVE CIRCUIT
212
212a
212c
212b
DRIVE CIRCUIT
213
213a
213c
213b
DRIVE CIRCUIT
214
214a
214b
DRIVE CIRCUIT
215
215a
215c
215b
DRIVE CIRCUIT
SENSOR GROUP
80
CPU
304
300
301
CPU
I/F
ROM
RAM
303
302
274
MAIN TRANSPORT CRIVE CIRCUIT
226
227
221
DRAWING-OUT ROLLER DRIVE CIRCUIT
275
267
266
284
DIVERSION DRIVE CIRCUIT
258
259
TAKING-IN ROLLER DRIVE CIRCUIT
255
256
254
PRESSURE MEMBER DRIVE CIRCUIT
268
269
254
DISPENSING ROLLER DRIVE CIRCUIT
285
281
282

GAME PLAY MEDIA LENDING MACHINE, FOR WHICH BANK NOTES CAN BE USED

TECHNICAL FIELD

This invention relates to a game play media lending machine used in a gaming house, such as a pachinko ball (Japanese pinball) hall, and in particular to a game play media lending machine capable of lending game play media to a player in response to the input of a large denomination bank note and moreover paying out change in small denomination bank notes.

TECHNICAL BACKGROUND

In a gaming house having gaming machines for a player to play a game with game play media, such as pachinko ball machines, the player needs to borrow game play media from the gaming house. A device used for this purpose is the game play media lending machine.

Generally, game play media lending machines are classified into those being responsive to an input bank note for dispensing as many game play media as the number of media determined for the amount of the bank note and those being responsive to the input of a large denomination bank note for dispensing as many game play media as the number of media determined for the specified amount by the player and also paying out change if necessary. In the latter game play media lending machines, if change is required, small denomination bank notes and/or coins prestored in the machine are paid out to the player as change.

However, when prestored bank notes and/or coins for change run out or are in short supply in the game play media lending machines having the change paying out capability, if a large denomination bank note is input, game play media cannot be lent until the machine is replenished with change. Thus, the machine often needs to be replenished with change. Also, since bank notes and coins are handled when the machine is replenished with change, there is a danger that the condition may give rise to crime.

Thus, hitherto, many gaming houses have had game play media lending machines allowing players to use only small denomination bank notes for which no change is required. However, since players cannot borrow game play media with a large denomination bank note from such gaming houses, they must endure the inconvenience to change bank notes of large denomination to small denomination whenever they wish to borrow game play media.

Since the dispensing units for lending game play media are fired to handle small denomination bank notes in the conventional machines, for the player to borrow game play media with a large denomination bank note, the gaming house pays out all the remaining amount of money as change. Thus, for the player to borrow game play media corresponding to a plurality of small denomination bank notes, he or she must input bank notes paid out as change into the game play media lending machine more than once.

DISCLOSURE OF INVENTION

It is a first object of the invention to provide a game play media lending machine capable of lending game play media to a player and paying out change in bank notes in response to the input of a large denomination bank note and moreover decreasing the time and labor expended for replenishing the machine with change.

It is a second object of the invention to provide a game play media lending machine capable of dispensing game play media successively more than once without paying out change when lending game play media in response to the input of a large denomination bank note.

To accomplish the first object, according to one aspect of the invention, there is provided a game play media lending machine for accepting a bank note input from the outside and lending game play media and if change is to be given, paying out a bank note as the change, the lending machine comprising:

a bank note validator/return unit having a bank note validation section for taking in an input bank note, determining at least the denomination of the bank note, and outputting information indicating acceptance of the bank note and amount information and a bank note return section for storing the bank note if it is a bank note that can be used for change and being responsive to a change paying out command for dispensing a necessary number of bank notes as change to the outside, using the stored bank notes;

a lending controller having dispensing control means for inputting the information indicating acceptance of the bank note and being responsive to a lending command for outputting a command for dispensing game play media in a given dispensing unit, operational means for inputting the amount information and subtracting an amount corresponding to the dispensing unit from an amount indicated by the amount information to find the remaining amount, and return control means for inputting the remaining amount and if the remaining amount is not zero, outputting a change paying out command to the bank note return section; and a game play media dispenser being responsive to a dispensing command for dispensing a predetermined number of game play media.

According to a second aspect of the invention, in addition to the first aspect, there is provided a game play media lending machine for accepting a bank note input from the outside and lending game play media and if change is to be given, paying out a bank note as change, the lending machine comprising:

a bank note validator/return unit having a bank note validation section for taking in an input bank note and outputting information indicating acceptance of the bank note and information required for determining at least the denomination of the bank note and a bank note return section for storing the bank note upon receipt of information indicating that it is a bank note that can be used for change and dispensing a necessary number of bank notes as change to the outside using the stored bank notes upon receipt of a change paying out command;

a lending controller having dispensing control means for inputting the information indicating acceptance of the bank note and being responsive to a lending command for outputting a command for dispensing game play media in a given dispensing unit, operational means for inputting the information required for determining the denomination and the amount information and subtracting an amount corresponding to the dispensing unit from an amount indicated by the amount information to find the remaining amount, and return control means for inputting the remaining amount and if the remaining amount is not zero, outputting a change paying out command to the bank note return section; and a game play media dispenser being responsive to a dispensing command for dispensing a predetermined number of game play media.

To accomplish the second object, according to a third aspect of the invention, in addition to the first aspect, there is provided a game play media lending machine further including a lending switch for accepting operation from the outside and inputting a game play media lending request command to the lending controller; and an adjustment switch for accepting operation from the outside and inputting an adjustment process request command to the lending controller, wherein upon receipt of the mount information from the bank note validity/return unit, the dispensing control means determines input of a lending command and outputs a dispensing command and upon receipt of the lending request command from the lending switch, outputs a dispensing command provided that the remaining amount is not zero, and wherein the return control means outputs a change paying out command provided that the adjustment process request command is input from the adjustment switch.

According to a fourth aspect of the invention, in addition to the second aspect, there is provided a game play media lending machine further including a lending switch for accepting operation from the outside and inputting a game play media lending request command to the lending controller; and an adjustment switch for accepting operation from the outside and inputting an adjustment process request command to the lending controller, wherein upon receipt of the information indicating acceptance of the bank note from the bank note validity/return unit, the dispensing control means determines input of a lending command and outputs a dispensing command, and upon receipt of the lending request command from the lending switch, outputs a dispensing command provided that the remaining amount is not zero, and wherein the return control means outputs a change paying out command provided that the adjustment process request command is input from the adjustment switch.

According to the invention, bank notes of the minimum denomination among bank notes available with the game play media lending machine are used as change, and when the number of stored change bank notes decreases, the input bank notes that can be used as change are collected and stored for change. Therefore, change can be paid out in bank notes and even if change is in short supply, the game play media lending machine can be automatically replenished with change bank notes from input bank notes, so that labor expended on replenishing the lending machine with change can be reduced drastically.

BEST MODE FOR CARRYING OUT THE INVENTION

Referring now to the accompanying drawings, there is shown one embodiment of the invention. In the embodiment, pachinko ball machines are installed as gaming machines in a gaming house and pachinko ball lending machines for lending pachinko balls used with pachinko ball machines are provided as game play media lending machines. The invention can be applied to various lending machines for lending game play media of not only pachinko balls, but also medals, coins, chips, etc.

Gaming machine islands (not shown) each comprising a plurality of gaming machines, are placed in the gaming house. Each gaming machine island has game play media lending machines each placed adjoining each of the gaming machines. The gaming machine island is provided with a transport system (not shown) being placed to the rear of the gaming machines and the game play media lending machines for taking in bank notes input to the game play media lending machines and transporting them to a cashbox (not shown) located in a part of the dome.

Figure 1:
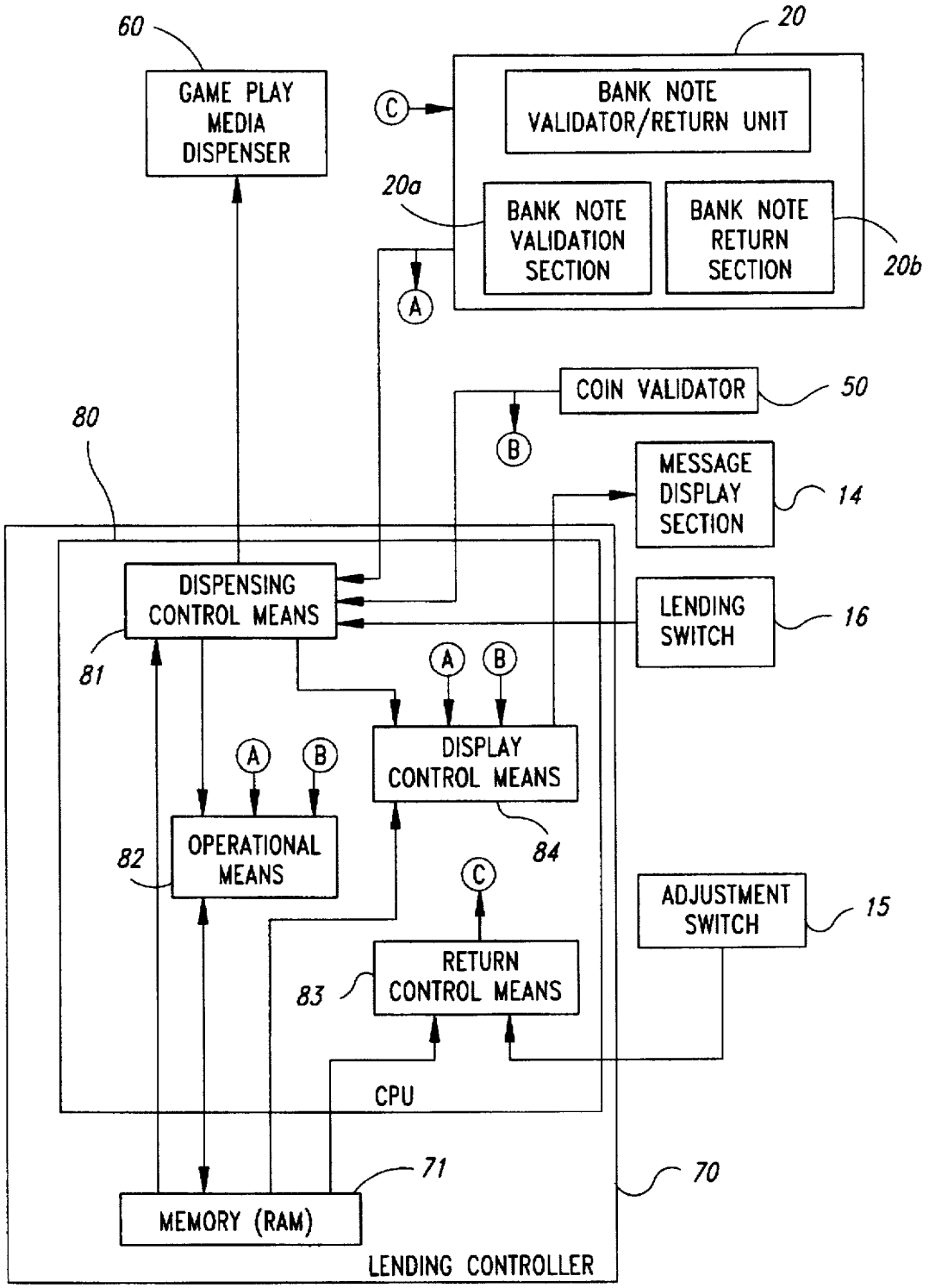
FIG. 1 is a block diagram showing the configuration of one embodiment of a game play media lending machine of the invention.
Figure 2:
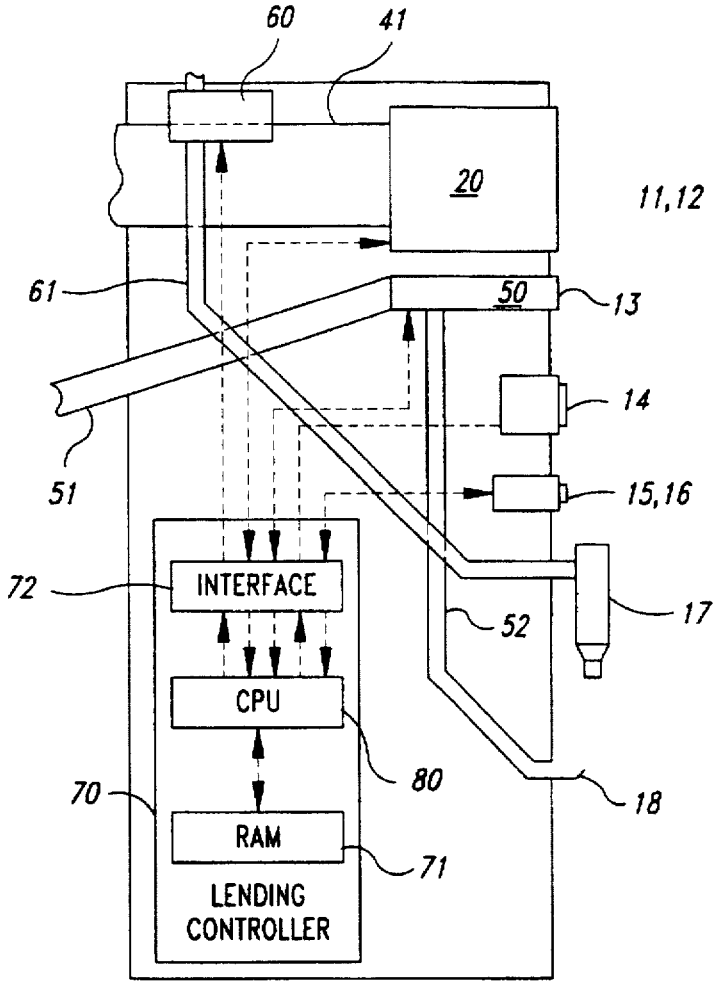
FIG. 2 is a side view showing an outline of the structure of the embodiment of the game play media lending machine of the invention from the side face thereof.
Figure 3:
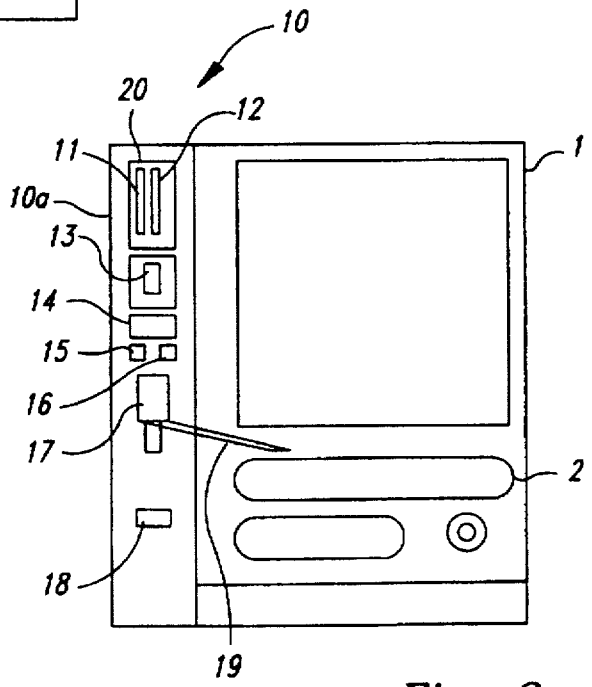
FIG. 3 is a front view showing an outline of the structure of the embodiment of the game play media lending machine of the invention.

The game play media lending machine of the embodiment is a pachinko ball lending machine 10, which is placed adjoining a pachinko ball machine 1, as shown in FIG. 3. The pachinko ball lending machine 10 has a bank note validator/return unit 20, a game play media dispenser 60, and a lending controller 70, as shown in FIGS. 1 and 2. It is provided with a lending switch 16 for accepting operation from the outside and inputting a lending process request command and an adjustment switch 15 for accepting operation from the outside and inputting an adjustment process request command. Further, the pachinko ball lending machine 10 is provided with a message display section 14 for displaying a message of change shortage, etc., and a coin validator 50 so that coins can be used in addition to bank notes.

Placed on the front of a case 10*a* of the pachinko ball lending machine 10 are a bank note slot 11 and a change dispensing port 12 on one end of the bank note validator/return unit 20, a coin slot 13 on one end of the coin validator 50, the message display section 14, the adjustment switch 15, the lending switch 16, a pachinko ball pot 17 for temporarily holding dispensed pachinko balls, and a coin outlet 18 for discharging returned coins from the coin validator 50, as shown in FIG. 3. Also, a supply passage 19 is placed for sending pachinko balls from the pachinko ball pot 17 to a pachinko ball holding part (return) 2 of the gaming machine 1.

The coin validator 50 determines the validity and denomination of a coin inserted through the coin slot, accepts only available coins, and counts the number of accepted coins for each denomination to find the total amount. When the amount reaches the amount corresponding to the game play media dispensing unit, the coin validator sends information indicating acceptance of the coins and their amount information to a CPU 80 of the lending controller 70. If unavailable coins are input, it rejects them to the coin outlet 18. The pending state is entered until the total amount reaches the dispensing unit. If a return button (not shown) is operated in this state, coins corresponding to the total amount of coins accepted in the pending state are returned.

The message display section 14 is made of, for example, a panel display, specifically a liquid crystal display. The embodiment uses a dot matrix display, but the display is not limited to it. For example, display segments may be placed in a part in accordance with the form of characters, graphics, etc., to be displayed. If messages, etc., are fixed, segments fitted to them may be provided. The message display section 14 displays information such as a message indicating that the bank note validator/return unit 20 contains insufficient change or a message indicating that some problem has occurred in addition to the amounts such as the input amount and the remaining amount.

In the embodiment, the adjustment switch 15 is made of, for example, a push-button switch. When the push-button switch is pushed, the adjustment switch 15 is mined on, generating an adjustment process request command, which is input to the lending controller 70. The adjustment switch 15 may be an illuminated button switch. If it is an illuminated button switch, when the adjustment switch is pushed, it goes on, enabling the player to easily check that he or she requests an adjustment process. At the end of adjustment, the switch may be reset.

In the embodiment, the lending switch 16 is made of, for example, a push-button switch. When the push-button switch is pushed, the lending switch 16 is turned on, generating a lending request command, which is input to the lending controller 70. The lending switch 16 may also be an illuminated button switch like the adjustment switch.

The pachinko bail lending machine 10 has the bank note validator/return unit 20, a transport passage 41, and the game play media dispenser 60 placed in the upper space of the case 10*a*, as shown in FIG. 2. The transport passage 41 is a part of the transport system for guiding bank notes determined to be valid by the bank note validator/return unit 20 and to be not used for change to the bank note cashbox (not shown) in the gaming machine island.

Upon receipt of a dispensing command from the lending controller 70, the dispenser 60 supplies a necessary number of pachinko bails received from a pachinko ball replenishment system (not shown) in the gaming machine island to the pachinko ball pot 17 via the transport passage 61. The number of dispensed pachinko balls can be made a given number per dispensing command, for example 100.

The coin validator 50 is placed in the space below the bank note validator/return unit 20. A transport passage 51, forming a part of a coin transport system for transporting coins determined to be valid to a coin cashbox (not shown) placed in a part of the gaming machine island, is linked with the rear end of the coin validator 50. A coin chute 52 for guiding coins to be returned to the coin outlet 18 is linked with the bottom of the coin validator 50.

Further, as shown in FIG. 2, the case 10*a* contains the lending controller 70, which has the central processing unit (CPU) 80 for performing control operations, etc., a memory 71, and an interface 72. The memory 71 is made of, for example, a random access memory (RAM). In the embodiment, the CPU 80 contains a nonvolatile memory (not shown) for storing the CPU's own programs. It executes the built-in programs to provide functions of dispensing control means 81, operational means 82, retrain control means 83, and display control means 84, as shown schematically in FIG. 1. These functions will be described later.

Figure 6:
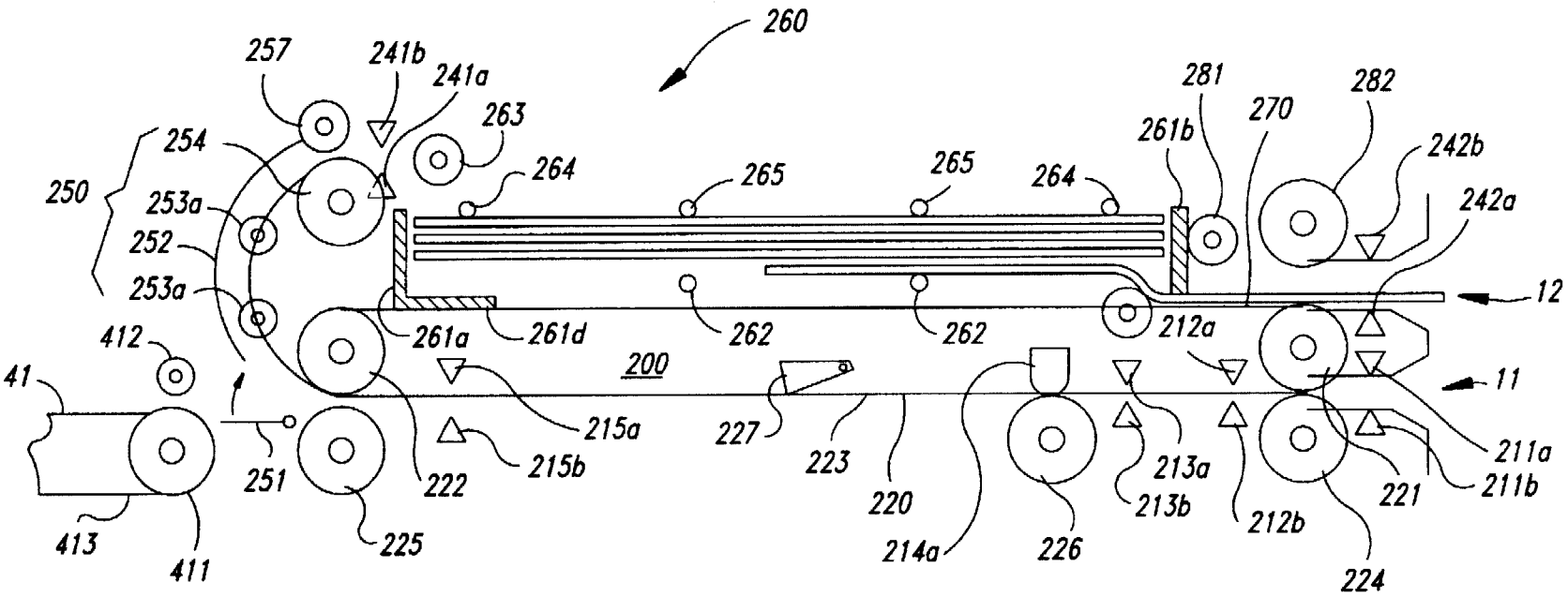
FIG. 6 is a transverse sectional view of the internal structure of the bank note validator/return unit, indicating a change bank note dispensing state.
Figure 7:
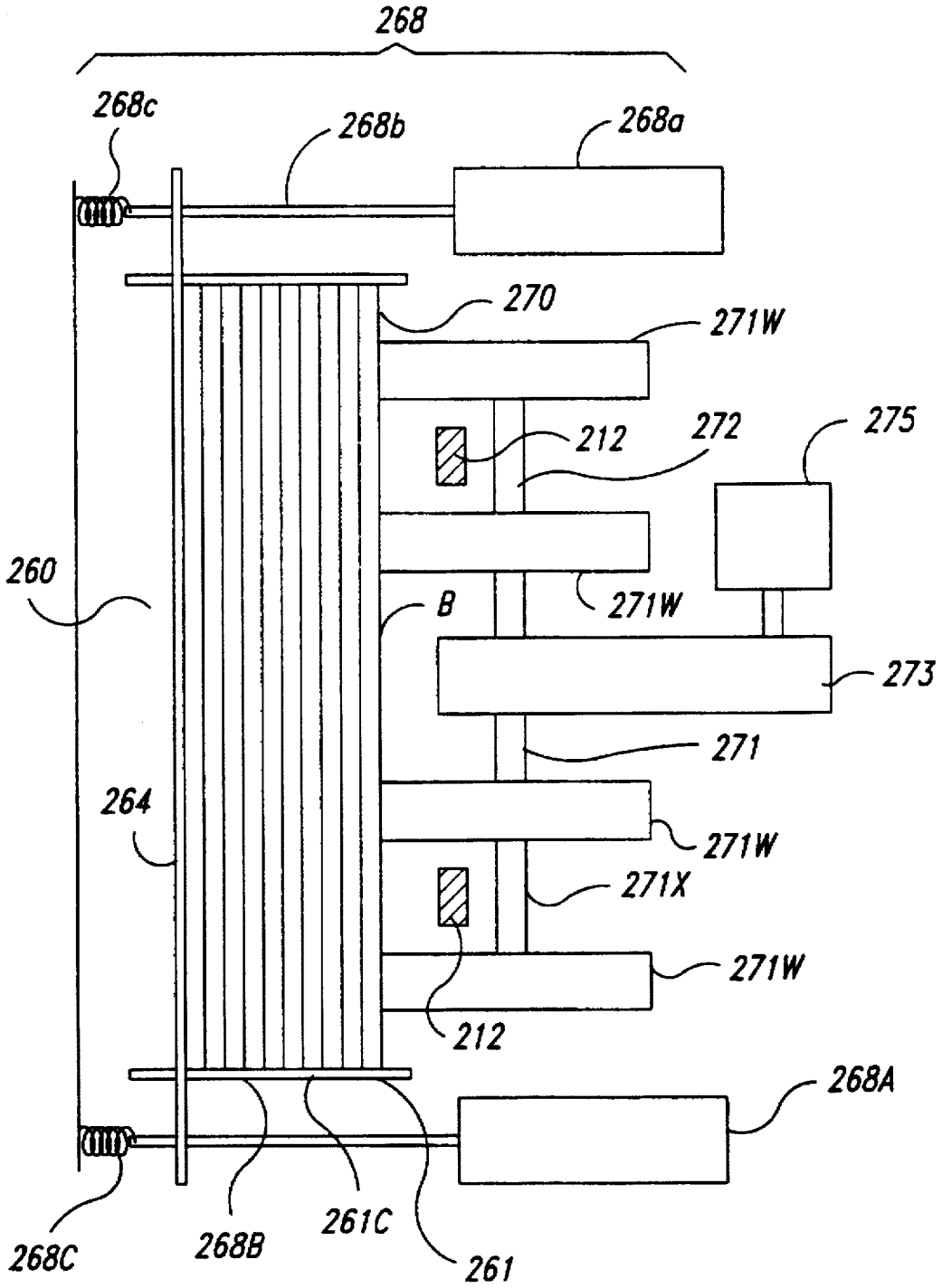
FIG. 7 is a sectional view of the main part showing a bank note storage mechanism and a bank note dispensing mechanism of the bank note validator/return unit.
Figure 8:
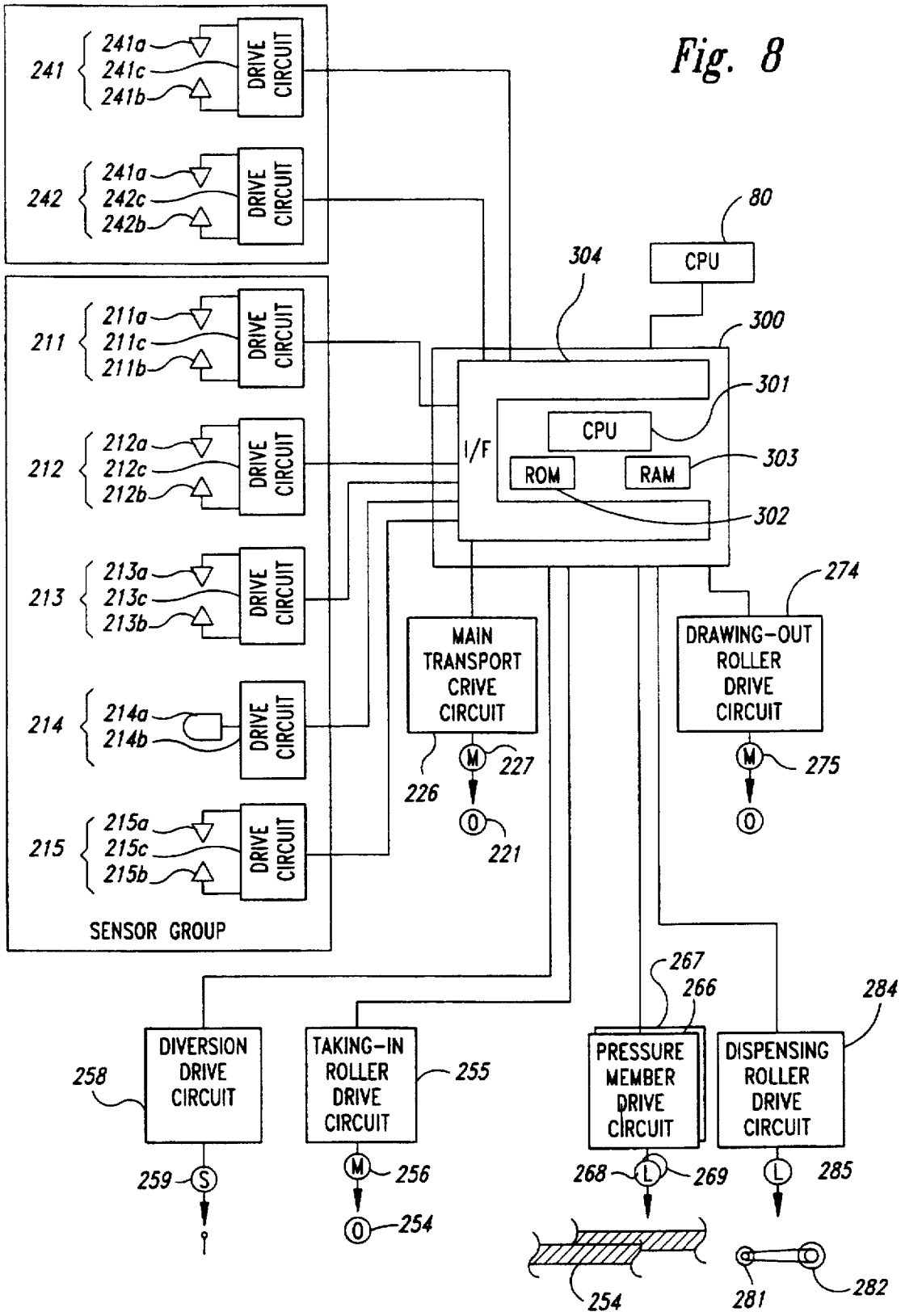
FIG. 8 is a block diagram showing the hardware system configuration of the bank note validator/return unit.

The bank note validator/return unit 20 consists of a bank note validation section 20*a* for accepting an input bank note, determining at least the denomination of the bank note, and outputting information indicating acceptance of the bank note and amount information and a bank note return section 20*b* for storing the bank note if it is a bank note that can be used for change and dispensing a necessary number of bank notes as change from the stored bank notes to the outside upon receipt of a change paying out command. Specifically, it consists of a mechanism as shown in FIGS. 4–7 and a control system as shown in FIG. 8.

That is, the bank note validation section 20*a* comprises a transport drive mechanism 200 for taking in a bank note input from the outside and transporting it, a sensor group 210 that can be used for detecting a signal required for determining at least the denomination of the taken-in bank note, and an information processor 300 which also functions as a determination section for receiving a signal from the sensor group 210, determining at least the denomination of the bank note, and outputting its amount information. In the embodiment, the bank note validation section 20*a* also has a function of determining the validity of a bank note.

The transport drive mechanism 200 is placed in a depth direction of the case 10*a* from its front and so as to transport bank notes with them upright, as shown in FIGS. 4–6 and 8. It comprises two conveyor belts 223 placed along the transport direction in spacing narrower than the width of bank notes to be transported, a drive pulley 221 and a driven pulley 222 on which the belts 223 are placed, rollers 224 and 225 being adjacent to the pulleys 221 and 222 for transporting bank notes with them positioned therebetween, a pinch roller 226 facing a sensor 214 to be described below, and a main transport drive circuit 1226 and a motor 1227 for driving the drive pulley 221. The side of the belts 223 on the extension of the bank note slot forms a main transport passage 220 for taking in bank notes. The main transport passage 220 is provided with a pawl 227 to prevent backward flow of bank notes. The backward flow prevention pawl 227 is a unidirectional motion mechanism for blocking reverse movement of a bank note once the rear end of the bank note passes therethrough.

A belt 413, a pulley 411, and a roller 412 forming a part of the transport passage 41 are placed downstream from the main transport passage 220. A part of a diversion mechanism 250 described below is placed between the driven pulley 222 and roller 225 and the pulley 411 and roller 412.

Figure 4:
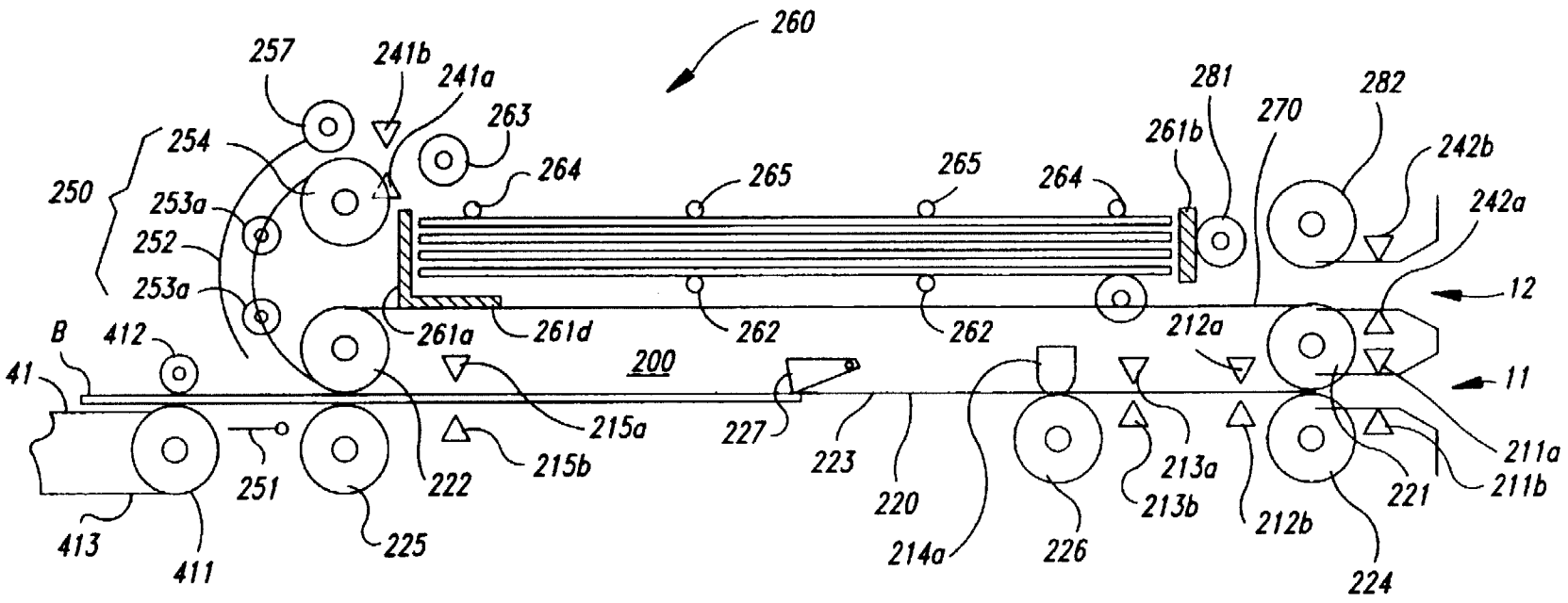
FIG. 4 is a transverse sectional view of the internal structure of a bank note validator/return unit used with the embodiment of the game play media lending machine of the invention, indicating a large denomination bank note taking-in state.

As shown in FIGS. 4 and 8, the sensor group 210 contains a sensor 211 for detecting the input of a bank note, a sensor 215 for sensing the termination of taking in a bank note, and sensors 212, 213, and 214 for detecting information necessary to determine the denomination and validity of a bank note. The sensor 211, which is disposed between the bank note slot 11 and the drive pulley 221 and the roller 224, senses whether or not the leading edge of a bank note passes through, and outputs a signal indicating the input of the bank note. The sensors 212, 213, and 214 are placed in order downstream from the drive pulley 221 and the roller 224. In fact, they are placed upstream from the position of the backward flow prevention pawl 227, as shown in FIG. 4. The sensor 215 is placed just preceding the driven pulley 222 and the roller 225.

Each of the sensors 211, 212, 213, and 215 is a photoelectric detection sensor comprising a light emission element, a light reception element, and a drive circuit for driving them and for taking out a signal in combination. For example, the sensor 211 consists of a light emitting diode 211*a*, a photodiode 211*b*, and a drive circuit 211*c*. The sensor 212 consists of a light emitting diode 212*a*, a photodiode 212*b*, and a drive circuit 212*c*. The sensor 213 consists of a light emitting diode 213*a*, a photodiode 213*b*, and a drive circuit 213*c*. The sensor 215 consists of a light emitting diode 215*a*, a photodiode 215*b*, and a drive circuit 215*c*. A plurality of each of the sensors 211, 212, 213, and 215 are placed in the width direction of bank notes (a direction at fight angles to the length of the bank notes). For example, information for determining whether or not the bank note width is a specified width can be provided by thus placing the sensors in the bank note width direction. Each of the drive circuits 211*c*, 212*c*, 21'*c*, and 215*c* converts a signal from the corresponding photodiode into a voltage signal, and also converts it into a digital signal for output so that the signal can be handled by the information processor.

The sensor 214 consists of a magnetic head 214*a* for read and a drive circuit 214*b*. It detects a magnetic component of ink used on a bank note and detects information necessary for determining the validity and denomination of the bank note.

On the other hand, the bank note return section 20*b* comprises a bank note storage mechanism 260 for taking in bank notes that can be used as change and storing them, a diversion mechanism 250 for diverting the flow of bank notes transported by the transport drive mechanism 200 into the path toward the bank note storage mechanism 260 upon receipt of a diversion command, and a change paying out mechanism 270 for taking out bank notes stored in the bank note storage mechanism 260 and dispensing them to the outside upon receipt of a paying out command. The information processor 300 also functions as a control section for controlling the operation of the members, as shown in FIGS. 4–8. The information processor 300 is shared by the bank note return section 20*b* and the bank note validation section 20*a*.

The diversion mechanism 250 comprises a diversion plate 251 placed between the driven pulley 222 and roller 225 and the pulley 411 and roller 412, a diversion drive circuit 258 and a solenoid 259 for driving the diversion plate 251, guide plates 252 and 253 for guiding bank notes into the bank note storage mechanism 260 in a U-turn fashion, a taking-in roller 254 for taking in bank notes to be stored, a roller 257 facing the roller 254 for putting bank notes therebetween, and a taking-in roller drive circuit 255 and a motor 256 for driving the taking-in roller 254. The guide plate 253 is provided with a plurality of minute rollers 253*a* for smoothing bank notes.

The diversion mechanism 250 has a sensor 241 for sensing bank notes stored in the bank note storage mechanism 260. Like the sensor 211, the sensor 241 consists of a light emitting diode 241*a*, a photodiode 241*b*, and a drive circuit 241*c*. It can sense the rear end of a bank note sent to the paper storage mechanism.

The bank note storage mechanism 260 comprises a storage section 261 for storing bank notes with them piled, support grids 262 adjoining the belts 223 for supporting the piled bank notes, a guide roller 263 being placed at the inlet of the storage section 261 for guiding the bank notes taken in by the taking-in roller 254 into the storage section 261, pressure members 264 and 265 for pressing and fixing the piled bank notes, and pressure member drive circuits 266 and 267 and linear motion actuators 268 and 269 for driving pressure members 264 and 265 to displace the pressure members 264 and 265.

The storage section 261 has a volume allowing a plurality of piled bank notes to be stored with them upright. It is provided with walls 261*a* and 261*b* to the front and rear ends of the bank notes so that the bank notes do not slide. Preferably, the belt 223 side of the front end wall 261*b* is lowered so that bank notes can be easily drawn out.

A plurality of the support grids 262 and 262 are provided for supporting bank notes. In the embodiment, two support grids are provided, but the number of support grids is not limited to two. Plate members may be placed on this portion. However, considering friction when bank notes are drawn out, the support grids 262 are preferred. Material of the support grids 262, 262 is not limited, but material with low friction is preferred for example, metal rods.

The guide roller 263 is provided to press a bank note so that the leading edge of the bank note taken in through a U turn by the diversion mechanism 250 is not detached from the storage section 261. Therefore, it is not limited to a roller if it has a similar function. For example, it may be a guide plate.

The pressure members 264 are placed near the front end and rear end of the storage section 261. On the other hand, the pressure members 265 are properly spaced from each other between the pressure members 264. The pressure members 264 and 265 are disposed displaceably in the bank note stacking direction. They are linked with the linear motion actuators 268 and 269 for driving them for displacement. Material of the pressure members 264 and 265 is not limited, but material with low friction is preferred, for example, metal rods.

The linear motion actuators 268 and 269 are the same in mechanism. As shown in FIG. 7, a pair of linear motion actuators is placed on the top and bottom of each of the pressure members 264 and 265. Specifically, the linear motion actuator can be made up of a support arm 268*b* with which the end of the pressure member is vertically linked, an elastic member being linked with one end of the support arm 268*b* for pressing and energizing the support arm 268*b* in the bank note pressing direction, such as a spring 268*c*, and an actuator 268*a* for displacing the support arm 268*b* against the spring 268*c*, such as a combination of a rack and pinion and a motor. In addition, a solenoid can be used.

When a bank note is stored, the pressure members 265 are detached alternately from stacked bank notes, whereby the newly stored bank note is stored and placed on the bank notes stacked so far. The pressure members 264 and 265 are used for this purpose. Also, they support bank notes in a state in which the bank notes are pressed by the springs 268*c*. Therefore, drawing out bank notes, as described below, is facilitated.

The support members 264 correspond to a side plate 261*d* and a drawing-out roller 271 described below. The support members 265 correspond to the support grids 262.

The change paying out mechanism 270 comprises a drawing-out roller 271 coming in contact with one of the bank notes stored in the storage section 261 and rotating to draw out the bank note from the storage section 261, a drawing-out roller drive circuit 274, a decelerator 273, and a motor 275 for driving the drawing-out roller 271, and dispensing rollers 281 and 282 for pressing the drawn-out bank note against the conveyor belts 223 and placing it between the rollers and the belts 223 for transporting the bank note to the change dispensing port 12. It further includes a sensor 242 for sensing that change is dispensed. The sensor 242 is placed between the dispensing roller 281 and the change dispensing port 12, and it consists of a light emitting diode 242*a*, a photodiode 242*b*, and a drive circuit 242*c*.

As shown in FIG. 7, the drawing-out roller 271 has four contact wheels 271*w*, which are driven by means of a common shaft 271*x* and which rotate while coming into contact with a bank note. Therefore, the surfaces of the contact wheels 271*w* are preferably formed of material with a large frictional force, such as rubber.

The dispensing rollers 281 and 282 are supported by a common support member (not shown), which is driven by a dispensing roller drive circuit 284 and a linear motion actuator 285, whereby the dispensing rollers 281 and 282 are displaced so as to come into contact with the conveyor belts 223.

As shown in FIG. 8, the information processor 300 comprises a central processing unit (CPU) 301, a read-only memory (ROM) 302 for storing CPU programs, fixed data, etc., a random access memory (RAM) 303 for storing data, etc., and an interface 304. It is connected to the CPU 80 for transferring signals therebetween. The fixed data includes data indicating the standard values and ranges of the feature amounts of bank notes of denominations that can be used.

The information processor 300 monitors signals sent from the drive circuits of the sensors 211–215, 241, 242 and performs bank note taking-in control, denomination determination, validity determination, diversion control, bank note storage control, bank note dispensing control, etc., in response to the input signals. For example, when the information processor 300 determines the denomination and validity of a bank note in response to the signals from the sensors 211–214 and determines that the bank note may be accepted for lending pachinko bails, it sends information indicating acceptance of the bank note, and its amount information, to the CPU 80 of the lending controller 70. Also, the information processor 300 detects the number of bank notes stored in the bank note storage section 261, and the number dispensed therefrom, in response to information from the sensors 241 and 242. Based on the numbers, it controls the diversion mechanism 250 for diversion. That is, if the input bank note is a bank note that can be used for change, the information processor 300 controls the diversion mechanism 250 to guide the bank note into the bank note storage section 261. If change is in short supply, it informs the CPU 80 of the fact. On the other hand, when receiving a change paying out command from the CPU 80, the information processor 300 instructs the drive circuits involved in the bank note dispensing operation to perform the operation required for bank note dispensing.

At least a part of the random access memory (RAM) 303 is made of a nonvolatile memory device. The total amount or number of bank notes stored as change is stored in the nonvolatile memory device, whereby the change amount is saved if the pachinko ball lending machine is powered off after the pachinko ball hall is closed. Thus, when the pachinko ball hall is opened again, only the pachinko ball lending machines for which a change shortage message is displayed on the message display section described below need to be replenished with change, so that the initialization job can be simplified.

Next, the function of the CPU 80 will be discussed. Since the coin validator 50 is provided in the embodiment, information indicating the acceptance of coins and coin amount information may be input, which will also be described.

The dispensing control means 81 monitors at least the input of signals from the outside of the lending controller 70, namely, a signal from the bank note validator/return unit 20, a signal from the coin validator 50, and a signal from the lending switch 16. When receiving information indicating acceptance of a bank note (or coins) corresponding to the dispensing unit amount from the information processor 300 (or the coin validator 50), the dispensing control means 81 inputs the information. Upon receipt of a lending command from the lending switch 16, it checks that a dispensing enable flag stored in the memory 71 is set before outputting a command for dispensing game play media in a given dispensing unit. If the dispensing enable flag is not set, the dispensing control means 81 does not output the dispensing command.

The embodiment assumes that the minimum denomination of an available bank note is set so as to match the dispensing unit amount of game play media. Thus, for the lending command just after a bank note is accepted, the information indicating bank note acceptance is assumed to be the lending command for processing. Therefore, in this case, the lending command need not be input from the lending switch 16 and the flag check can also be omitted. Of course, the invention is not limited by this assumption. The information indicating coin acceptance from the coin validator 50 is also output when coins of the amount corresponding to the dispensing unit are accepted. Therefore, coins can also be handled like bank notes.

When the operational means 82 inputs the amount information from the information processor 300 (or the coin validator 50) and receives information to the effect that game play media have been dispensed from the dispensing control means 81, it subtracts the amount corresponding to the number of dispensed game play media from the input amount information, to find the remaining amount of money. In this case, if the remaining amount stored in the memory 71 is not 0, the operational means 82 adds the remaining amount to find a new remaining amount of money. It replaces the remaining amount stored in the memory 71 with the calculation result. The operational means 82 checks to see if the remaining amount is an amount enabling game play media to be dispensed next time and if so, sets the dispensing enable flag. If the remaining amount is less than the dispensing unit amount, the operational means 82 resets the dispensing enable flag and sends a command to the display control means 84 for requesting the means 84 to display a message to the effect that the remaining amount is insufficient to dispense game play media. In the embodiment, the input amount information becomes an integer multiple of the dispensing unit amount and therefore when the remaining amount is less than the dispensing unit amount, it is 0.

Thus, the game play media dispensing unit is made to match the amount of a bank note that can be dispensed as change, whereby bank notes provided as change can be made those of only one denomination, and calculation is facilitated because no fractions result.

The return control means 83 is started when the adjustment switch 15 is pressed. When the means 83 is started, it checks the remaining amount of money stored in the memory 71 and if the remaining amount exists, outputs a command for paying out as much change as the amount to the bank note validator/return unit 20.

Thus, in the embodiment, change is paid out provided that the adjustment switch 15 is pressed. If the player does not press the adjustment switch 15 until ending the game play, he or she needs only to press the lending switch for additional lending of game play media, and can omit additional input of bank notes or coins. At the pachinko ball lending machine, change paying out can be decreased, leading to a decrease in change consumption.

The display control section 84 displays information of the remaining amount, etc., and messages concerning change shortage, etc., on the message display section 14. For example, when inputting amount information from the bank note validator/return unit 20 or the coin validator 50, the display control section 84 displays the amount as the input amount. It also reads the remaining amount stored in the memory 71 to display it as the remaining amount. Further, when receiving change shortage information from the bank note validator/return unit 20, the display control section 84 displays a message indicating the event. When some problem such as failure occurs in the bank note validator/return unit 20 or the coin validator 50, it displays a message indicating the event.

The memory 71, which is made of a random access memory 71, at least stores the remaining amount as described above, and also stores data, etc., required for the operation of the CPU 80. At least a part of the memory 71 may be made nonvolatile.

Next, the bank note validation and dispensing operation of the pachinko ball lending machine of the embodiment will be discussed with reference to FIGS. 1–9. The embodiment assumes that the game play media dispensing unit of the pachinko ball lending machine is 1000 yen and that the currency available with the pachinko ball lending machine is 1000-yen, 5000-yen, and 10000-yen bank notes and 500-yen and 100-yen coins. The invention can also be applied if different currency is handled, needless to say.

First, the pachinko ball lending machine is initialized in the gaming house by setting a predetermined number of change bank notes (in the embodiment, 1000-yen bank notes) in the bank note storage section 261 of the bank note storage mechanism 260. For example, 20 bank notes are provided. In FIGS. 4, etc., a number of bank notes less than 20 are shown for simplicity of the drawings. The number of bank notes is not accurately represented in the drawings.

To set change bank notes, the pachinko ball lending machine 10 placed adjoining the gaming machine 1 as shown in FIG. 3 is drawn out toward the front to the condition as shown in FIG. 2 and a cover (not shown) of the bank note validator/return unit 20 is removed, then 20 piled bank notes are entered in the storage section 261. The number of bank notes is prespecified in a program specifying the operation of counting the number of change bank notes. Therefore, the number of bank notes is accurately counted and bank notes are set.

A switch for inputting the number of bank notes may be provided for inputting the actual number of set bank notes. In this case, the numeric value is not specified in the program. Instead, the CPU 301 of the information processor 300 reads the number of bank notes entered through the switch at the initialization and sends it to the lending controller 70.

To set change bank notes, for example, they may be inserted through the bank note slot 11 one at a time. In this case, a change shortage message is displayed on the message display section 14 after the information processor 300 is started. The operator may respond to the message with the input of a bank note. When a bank note is input, as described below, the input bank note is stored in the bank note storage section 261 by the operation as in change shortage, and is counted by the sensor 241. In this case, it takes time and labor to input the bank notes one at a time, but bank note input can be tested at the same time.

Upon completion of starting the validator/return unit 20 in this state, the pachinko ball lending machine 10 can be used. At this time, a message indicating the event or a message representing a welcome to a player may be displayed on the message display section 84.

When a player inserts a bank note through the bank note slot 11, the bank note blocks light emitted from the light emitting diode **211*a* of the sensor 211, and thus the photoelectric current of the photodiode 211*b* changes. The drive circuit converts the photo-electric current change into a sensing signal and sends it to the information processor 300. As shown in FIG. 8, the signal is sent via the interface 304 to the CPU 301. In the embodiment, the drive circuit 211*c* checks whether or not sensing signals are input from both of a pair of sensors 211 placed in the bank note width direction. For example, it can be checked by AND outputs of both sensors. If the signals are input from both the sensors, the drive circuit 211*c* determines that the bank note is input in the normal insertion condition, and outputs a sensing signal indicating input of the bank note. On the other hand, if the sensing signal is input only from one of the sensors 211, the drive circuit 211*c*** determines that the bank note is input in the abnormal insertion condition, and ignores the signal input.

A request for displaying a message "INSERT BANK NOTE NORMALLY" on the message display section 14 may be sent via the CPU 301 to the lending controller 70.

Figure 9:
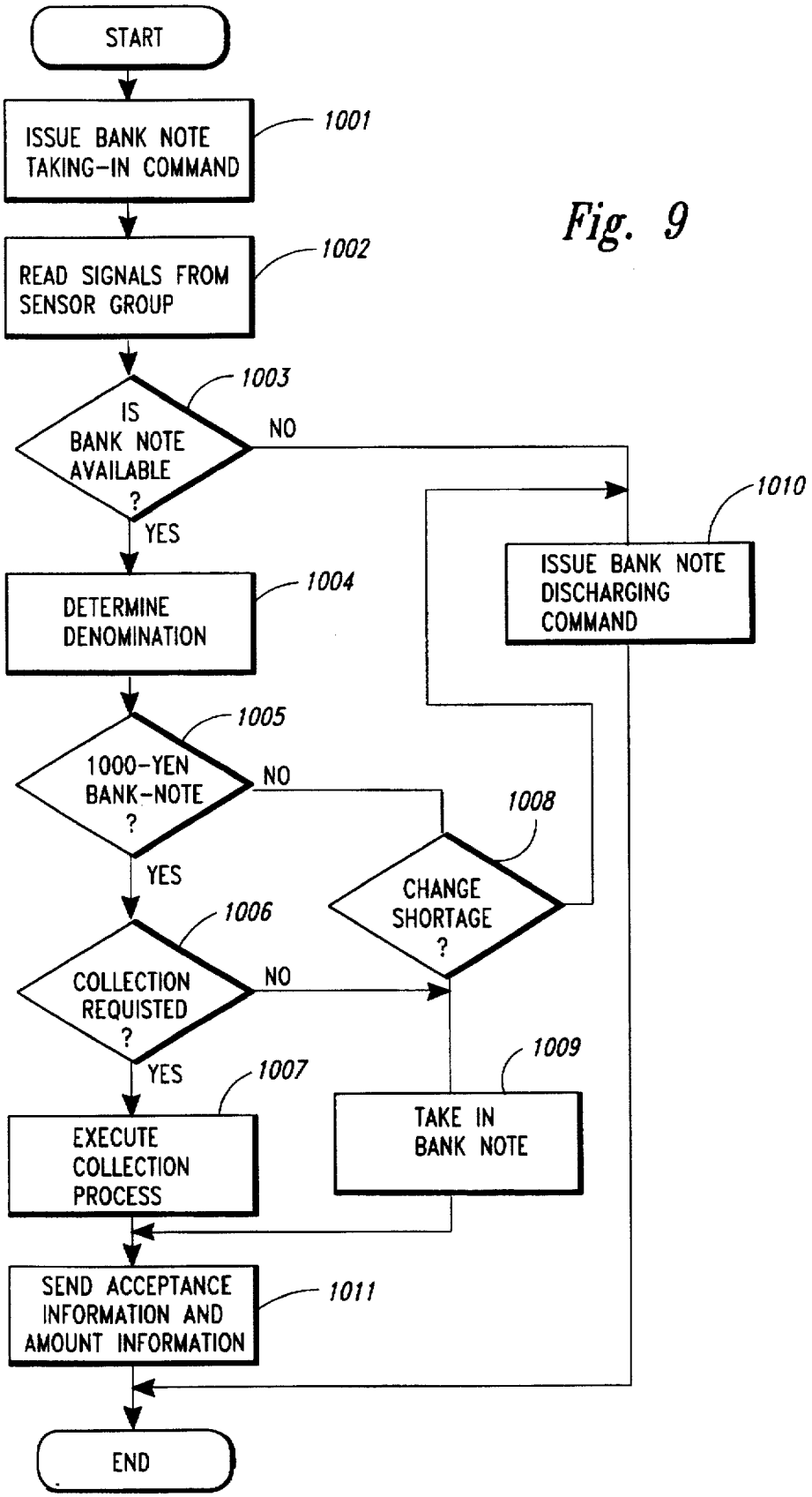
FIG. 9 is a flowchart showing one example of a bank note taking-in process in the bank note validator/return unit.

Upon receipt of the bank note input sensing signal, the CPU 301 executes a bank note input process shown in FIG. 9. That is, the CPU 301 commands the main transport drive circuit 1226 to take in the bank note at step 1001. Upon receipt of the bank note taking in command, the main transport drive circuit 1226 drives the motor 1227, whereby the drive pulley 221 turns clockwise in FIG. 4, moving the conveyor belts 223 in the same direction, whereby the leading edge of the bank note is placed between the pulley 221 and the roller 224 and taken into the inside of the bank note validator/return unit 20 on the main transport passage 220 by the belts 223.

In the bank note taking in process on the main transport passage 220, the sensors 212, 213, and 214 collect information required for determining the denomination and validity of the bank note. For example, the edges in width and length direction, transmission factor, magnetism, etc., of the bank note are detected. The CPU 301 collects these pieces of information at step 1002.

The information processor 300 determines the denomination and validity of the bank note at steps 1003 and 1004. That is, it extracts predetermined feature amounts of the width, length, presence or absence and distribution of a specific mark, magnetic component distribution, transmission factor distribution, etc., of the input bank note and compares them with the prestored standard feature amounts and ranges for determining whether or not the bank note can be used and the amount thereof. If the information processor 300 determines that the input bank note does not correspond to any feature amounts of a usable bank note, namely, if the bank note is not valid, it commands the main transport drive circuit 1226 to discharge the bank note at step 1010. In response to the command, the main transport drive circuit 1226 reversely drives the motor 1227 to discharge the bank note.

On the other hand, if the bank note is a usable bank note, the information processor 300 determines whether or not the bank note is a 1000-yen bank note at step 1005. If it is not a 1000-yen bank note, namely, it is a 5000-yen or 10000-yen bank note, the information processor 300 determines whether or not change is in short supply at step 1008. That is, the information processor 300 checks the total amount of change bank notes in the RAM 303 to see if as much as 4000 yen of change exists if the bank note is a 5000-yen bank note or as much as 9000 yen of change exists if the bank note is a 10000-yen bank note. If the change is sufficient, the bank note is taken into the pachinko ball lending machine at step 1009. On the other hand, if the change is in short supply, the information processor 300 issues a command for discharging the bank note at step 1010. If the change is in short supply, when the change shortage condition is reached, the bank note validator/return unit 20 senses it and notifies the lending controller 70 of the event to cause a message to be displayed on the message display section 14.

If the input bank note is a 1000-yen bank note, the information processor 300 determines whether or not the bank note needs to be collected at step 1006. That is, it checks the total amount of change bank notes in the RAM 303 to see if the bank notes stored in the bank note storage section 361 shown in FIG. 4 reach the specified number of stored bank notes. If the bank notes do not reach the specified number of bank notes, the CPU 301 executes a collection process at step 1007. If the bank note causes the specified number of bank notes to be reached, the bank note is not collected for change and is taken into the pachinko ball lending machine like other large denomination bank notes at step 1009.

After this, for the collected or taken-in bank note, the CPU 301 sends information indicating acceptance of the bank note, and amount information to the lending controller 70 at step 1011.

The bank note taking in process at step 1009 and the collection process at step 1007 will be discussed further.

Upon receipt of a bank note taking in command from the CPU 301, the diversion drive circuit 258 drives the solenoid 259 for setting the diversion plate 251 so as to allow the main transport passage 220 to communicate with the transport system 41. That is, the diversion plate 251 is placed in the state shown in FIG. 4. If the diversion plate 251 is already placed in this state, the command is ignored. FIG. 4 shows a state in which a bank note B is being taken into the transport system 41 by means of the pulleys 411 and the belts 413 and the roller 412.

On the other hand, at step 1007, upon reception of a bank note collection command from the CPU 301, the diversion drive circuit 258 drives the solenoid 259 for setting the diversion plate 251 so as to allow the main transport passage 220 to communicate with the diversion mechanism 250 and the bank note storage mechanism 260. That is, the diversion plate 251 is placed in the state shown in FIG. 5. If the diversion plate 251 is already placed in this state, the command is ignored. The CPU 301 commands the pressure member drive circuit 267 to retract the pressure members 265 and 265 in the paper storage section 261 in the direction away from the belts 223. In response to the command, the pressure member drive circuit 267 causes the linear motion actuator 269 to displace the pressure members in the direction away from the belts 223. At this time, the pressure members 264 are in a state pressing piled bank notes in the paper storage section 261 toward the belts 223.

Figure 5:
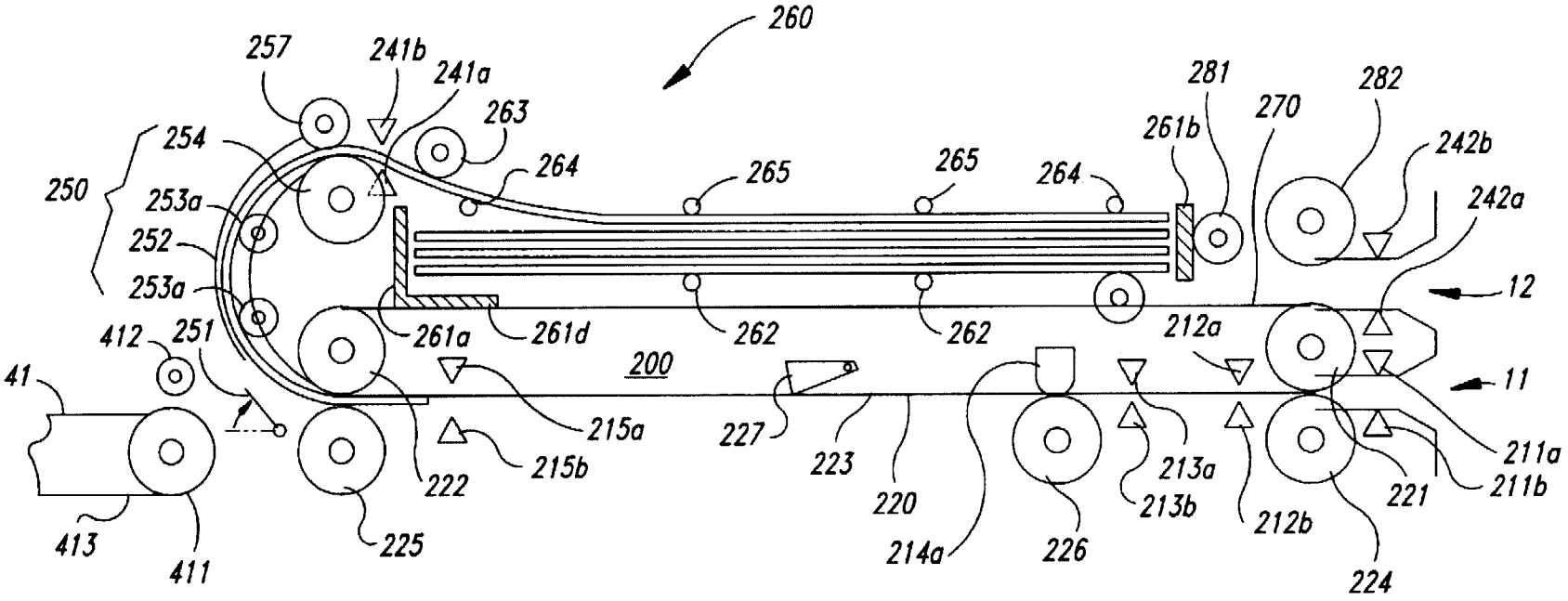
FIG. 5 is a transverse sectional view of the internal structure of the bank note validator/return unit, indicating a change bank note taking-in state.

In addition to such preparation, the CPU 301 commands the taking-in roller drive circuit 255 to drive the taking-in roller 254. In response to the command, the taking-in roller drive circuit 255 drives the motor 256, whereby the bank note is guided by the guide plates 252 and 253 of the diversion mechanism 250 into the bank note storage section 361 by means of the belts 223 and the taking-in roller 254, as shown in FIG. 5. At this time, the guide roller 253*a* reduces friction. The rollers 257 and 263 forcibly guide the bank note B being bent like a letter U, toward the bank note storage section 261.

When the rear end of the bank note B passes through the position of the backward flow prevention pawl 227, the pawl 227 falls downward, thus preventing the passed bank note from flowing backwards, whereby an illegal act, such as pulling out a bank note with thread, can be prevented.

As shown in FIG. 5, when the rear end of the bank note B has passed through the sensor 215, the CPU 301 determines that the bank note collection is complete, and stops driving the pulley 221 after a lapse of the time taken for the rear end of the bank note to be detached from the belts 223. This is also the same as the case where the bank note is taken into the transport system 41.

When the bank note B is thus stored in the bank note storage section 261, the pressure members 264 and 264 are positioned on the side nearer the belts 223 than the taken-in bank note. On the other hand, the pressure members 265 are positioned on the side farther from the belts 223 than the taken-in bank note.

Then, the CPU 301 commands the pressure member drive circuits 266 and 267 to displace the pressure members 264 in the direction away from the belts 223 and the pressure members 265 nearer to the belts 223. Thus, the taken-in bank note is piled together with other piled bank notes and supported by the pressure members 265. At the same time, both ends of the taken-in bank note are detached from the pressure members 264 and the bank note is positioned nearer the belt 223 side than the pressure members 264.

Further, the CPU 301 commands the pressure member drive circuit 266 to make the pressure members 264 approach the belts 223. In response to the command, the pressure member drive circuit 266 causes the linear motion actuator 268 shown in FIG. 7 to displace the pressure members 264 nearer to the belts 223, whereby the pressure members 264 and 265 are placed so as to press the stacked bank notes containing the taken-in bank note nearer to the belts 223, as shown in FIG. 6.

When the sensor 241 senses the rear end of the bank note, the CPU 301 adds the amount of the taken-in bank note to the change amount set in the RAM 303.

Whenever a 1000-yen bank note is input, the above operation is performed, thereby providing a specified number of bank notes required for change.

Next, paying out change will be discussed.

When receiving a change paying out command from the return control means 83 of the lending controller 70, the CPU 301 first sets the amount to be paid out in a predetermined area of the RAM 303. Next, the CPU 301 commands the drawing-out roller drive circuit 274 to draw out a bank note from the bank note storage section 261. In response to the command, the drawing-out roller drive circuit 274 drives the motor 275 to turn the drawing-out roller 271 clockwise in FIG. 6, whereby the bank note being in contact with the draw-out roller 271 is drawn out in the direction of the change dispensing port (bank note dispensing port) 12. Specifically, the contact wheels 271*w* are turned by means of the shaft 271*x*, as shown in FIG. 7.

The CPU 301 further commands the dispensing roller drive circuit 284 to displace the dispensing rollers 281 and 282 to positions coming in contact with the belts 223. At the same time, it commands the main transport drive circuit 226 to turn the drive pulley 221 clockwise. In response to the command, the dispensing roller drive circuit 284 operates the linear motion actuator 285 for displacing the dispensing rollers 281 and 282 to put the bank note between the rollers 281 and 282 and the belts 223. The pulley 221 is moved by the motor 227 responsive to the main transport drive circuit 226 for transporting the bank note and dispensing it through the change dispensing port 12.

When the dispensing sensor 242 senses the rear end of the bank note and outputs a signal, the CPU 301 receives the signal and subtracts the amount of the dispensed bank note from the change amount to be paid out set in the RAM 303. If the remaining amount exists, the dispensing operation is repeated until the remaining amount reaches 0, whereby change is paid out.

On the other hand, the CPU 301 receives the signal of the dispensing sensor 242 and subtracts the amount of the dispensed bank note from the total amount of change bank notes set in the RAM 303. It determines whether or not the remaining amount causes change shortage. If it causes change shortage, the CPU 301 checks whether the change shortage is a shortage of 1000-yen or 5000-yen bank notes, and notifies the CPU 80 of the lending controller 70 of the check result for displaying it on the message display section 14.

In the operation of the bank note validator/return unit 20 described above, change is managed according to the change amount, but can also be managed according to the number of bank notes.

Figure 10A:
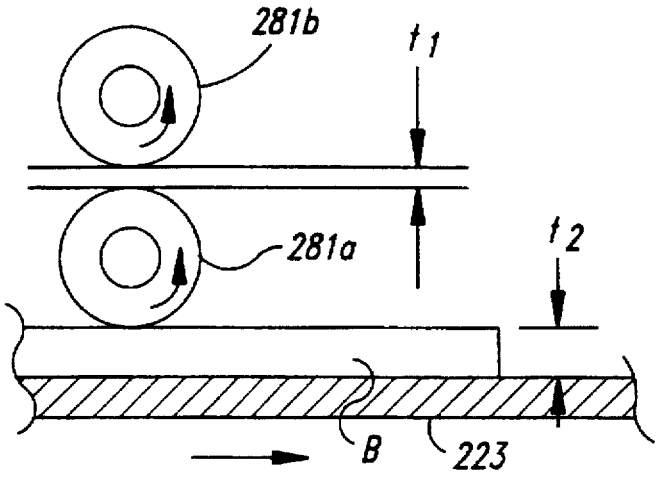
FIG. 10A is an illustration showing an example of a mechanism for preventing stacked bank notes from being discharged together, wherein only one bank note is drawn out.
Figure 10B:
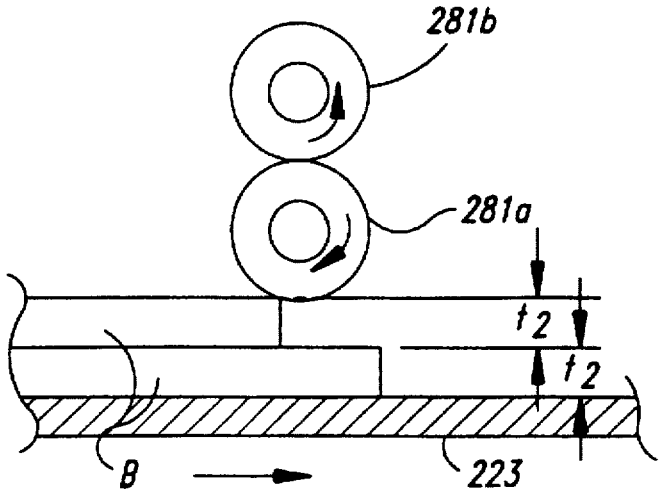
FIG. 10B is an illustration showing an example of a mechanism for preventing stacked bank notes from being discharged together, wherein two bank notes are drawn out together.

Next, FIGS. 10A and 10B show an example of a mechanism that can be disposed in the bank note validator/return unit of the embodiment for preventing more than one bank note from being discharged together.

In this example, a drive roller 281*b* and a driven roller 281*a* are provided in place of the dispensing roller 281 in FIG. 6, and the maximum spacing between the drive roller 281*b* and the driven roller 281*a* is set to (t1+t2) where t1<t2 and t2 is an average thickness of a change bank note. The driven roller 281*a* is supported displaceably in a direction perpendicular to the conveyor belts 223. Further, the drive roller 281*b* is always driven counterclockwise by a motor (not shown).

When only one bank note B is dispensed and transported on the belts 223, the driven roller 281*a* and the drive roller 281*b* are spaced from each other at the t1 interval, as shown in FIG. 10A. On the other hand, as shown in FIG. 10B, if two bank notes B are drawn out on top of each other, the driven roller 281*a* is pushed up by the two bank notes B and comes in contact with the drive roller 281*b*. As a result, the driven roller 281*a* turns clockwise, pushing back the upper bank note B in the reverse direction to the bank note B dispensing direction. Therefore, only the lower bank note B is dispensed.

We claim:

1. A game play media lending machine for accepting a bank note input from outside the lending machine and lending game play media, and, if change is to be given, paying out a bank note as change, said game play media lending machine comprising:

a bank note validator/return unit having a bank note validation section for taking in an input bank note, determining at least the denomination of the bank note, and outputting information indicating acceptance of the bank note and information of determining the denomination of bank note, a bank note return section for storing the bank note if it is a bank note that can be used for change, the return section being responsive to a change paying out command for dispensing a necessary number of bank notes as change to the outside using the stored bank notes, and an information processor for controlling operations of the validation and return sections;

a lending controller having dispensing control means for inputting the information indicating acceptance of the bank note and being responsive to a lending command for outputting a command for dispensing game play media in a given dispensing unit, operational means for inputting the information of determining the denomination of bank note and subtracting an amount corresponding to the dispensing unit from an amount defined corresponding to the information of determining the denomination of bank note to find the remaining amount, and return control means for inputting the remaining amount and if the remaining amount is not zero, outputting a change paying out command to said bank note return section; and a game play media dispenser being responsive to a game play media dispensing command for dispensing a predetermined number of game play media, and the bank note validation section comprising:

a transport drive mechanism for drawing in a bank note input from the outside and transporting it; and a sensor group for detecting and outputting information for determining at least denomination of the drawn-in bank note;

the bank note return section comprising:

a bank note storage mechanism for storing bank notes that can be used for change;

a switching mechanism being responsive to a switching command for switching a bank note transported by said transport drive mechanism into a path toward the bank note storage mechanism and feeding the bank note into the bank note storage mechanism; and a change paying out mechanism being responsive to a paying out command for taking out bank notes stored in the bank note storage mechanism and dispensing them to the outside;

the bank note storage mechanism comprising:

a storage section for stacking a plurality of bank notes so as to store the bank notes;

a support member being located on one side of the stacked bank notes in said storage section for supporting the stacked bank notes;

first pressure members being disposed displaceably in a bank note stacking direction with respect to the support member for putting the stacked bank notes between said first pressure members and the support member and pressing the bank notes near both ends in the length of the bank notes, and a second pressure member for pressing the bank notes at a position between the pressing positions of the first pressure members; and first and second drive mechanisms for respectively displacing the first and second pressure members in a bank note pressing state and a state away from the bank notes independently of each other, wherein the information processor has means, when a bank note is fed into said storage section by said switching mechanism, for commanding the second drive mechanism to displace the second pressure member to the state away from the stacked bank notes and setting a bank note fixing state by the first pressure members and said support member, then feeding the bank note between the first and second pressure members, and, when the bank note to be stacked is fed, said means commanding the second drive mechanism to displace the second pressure member to the bank note pressing state and the first drive mechanism to temporarily displace the first pressure member positioned between the already stacked bank notes and the immediately fed bank note in a direction away from the bank notes for placing said first member outside the immediately fed bank note, and then to displace said first member so as to press all the bank notes.

2. The game play media lending machine as claimed in claim 1, wherein said bank note validation section further comprises:

a determination section being responsive to the information for determining the denomination from said sensor group for determining at least the denomination of the bank note and outputting denomination information indicating the denomination.

3. The game play media lending machine as claimed in claim 2, wherein said bank note return section comprises:

a bank note storage mechanism for taking in bank notes that can be used for change and storing them;

a diversion mechanism being responsive to a diversion command for diverting a bank note transported by said transport drive mechanism into a path toward said bank note storage mechanism; and a change paying out mechanism being responsive to a paying out command for taking out bank notes stored in said bank note storage mechanism and dispensing them to the outside.

4. The game play media lending machine as claimed in claim 3, wherein said bank note return section further includes a dispensed bank note counting sensor for counting the bank notes to be dispensed to the outside as change.

5. The game play media lending machine as claimed in claim 4, wherein said bank note return section further includes a stored bank note counting sensor for counting the number of bank notes switched by said switching mechanism and stored in said bank note storage mechanism.

6. The game play media lending machine as claimed in claim 5 further including operational means for finding the current number of stored bank notes based on a signal from said stored bank note counting sensor, a signal from said dispensed bank note counting sensor, and an initial value.

7. The game play media lending machine as claimed in claim 6, wherein said operational means determines whether or not the current number of stored bank notes reaches an upper limit of stored bank notes, and when said current number reaches the upper limit, said operational means inhibits said switching mechanism from switching bank notes.

8. The game play media lending machine as claimed in claim 7, wherein said operational means determines whether or not the current number of stored bank notes is the number of bank notes required for paying out change for each of large denomination bank notes available in said machine, and, if change is in short supply, outputs information indicating the unavailable denomination.

9. The game play media lending machine as claimed in claim 8, wherein said transport drive mechanism is configured so as to be able to reverse, and is responsive to a reverse command for reversing a bank note transport direction for discharging an input bank note.

10. The game play media lending machine as claimed in claim 9, wherein said determination section inputs and holds the information indicating the unavailable denomination and determines whether or not the denomination information determined on the bank note drawn in by said transport drive mechanism shows the unavailable denomination, and, when it is the unavailable denomination, outputs a reverse command.

11. The game play media lending machine as claimed in claim 10 further including a message display section for displaying a message for informing a state of said machine to the outside, wherein said lending controller further includes a display control section for receiving information to be displayed and controlling display of the information on said message display section.

12. The game play media lending machine as claimed in claim 10, wherein said sensor group contains a sensor for detecting a signal used to determine validity of a bank note, and wherein said determination section is responsive to the signal from said sensor group for further determining the validity of a bank note, and when determining that the bank note is not a valid available bank note, outputs a reverse command.

13. The game play media lending machine as claimed in claim 2, further including a lending switch for accepting operation from the outside and inputting a game play media lending request command to said lending controller; and an adjustment switch for accepting operation from the outside and inputting an adjustment process request command to said lending controller, wherein upon receipt of the denomination information from said bank note validity/return unit, said dispensing control means determines input of a lending command and outputs a game play media dispensing command and upon receipt of the lending request command from said lending switch, outputs a game play media dispensing command provided that the remaining amount is not zero, and wherein said return control means outputs a change paying out command provided that the adjustment process request command is input from said adjustment switch.

14. The game play media lending machine as claimed in claim 13, further including a message display section for displaying a message for informing a state of said machine to the outside, wherein said lending controller further includes a display control section for receiving information to be displayed and controlling display of the information on said message display section.

15. A bank note validator/return machine for accepting a bank note, determining a denomination of the accepted bank note, and paying out a bank note as change, said bank note validator/return machine comprising:

a bank note validation section for taking in an input bank note, and outputting at least information indicating an acceptance of the bank note and denomination information showing the denomination of the bank note;

a bank note return section for judging, upon acceptance of the denomination information, whether or not the bank note can be used for change, and if it is a bank note that can be used for change, storing the bank note, and being responsive to a change paying out command for dispensing a necessary number of stored bank notes to the outside as change; and an information processor for controlling operations;

the bank note validation section comprising:

a transport drive mechanism for drawing in a bank note input from the outside and transporting it; and a sensor group for detecting denomination information which is needed to determine the denomination of the accepted bank note, and for outputting the denomination information;

the bank note return section comprising:

a bank note storage mechanism for storing bank notes that can be used for change;

a diversion mechanism being responsible to a diversion command for diverting a bank note transported by said transport drive mechanism into a path toward the bank note storage mechanism and feeding the bank note into the bank note storage mechanism; and a change paying out mechanism being responsive to a paying out command for taking out a bank note stored in the bank note storage mechanism and dispensing it to the outside;

the bank note storage mechanism comprising:

a storage section for stacking a plurality of bank notes so as to store the bank notes;

a support member being located on one side of the stacked bank notes in said storage section for supporting the stacked bank notes;

first pressure members being displaceably disposed in a bank note stacking direction with respect to the support member for putting the stacked bank notes between said first pressure members and the support member and pressing the stored bank notes near both ends in the length of the stacked bank notes;

a second pressure member for pressing the stacked bank notes at a position between the pressing positions of the first pressure members; and first and second drive mechanisms for respectively and independently displacing the first and second pressure members in a bank note pressing state and a state away from the bank notes, wherein the information processor has means, when a bank note is fed into said storage section by said diversion mechanism, for commanding the second drive mechanism to displace the second pressure member to the state away from the stacked bank notes and for setting a bank note fixing state with the first pressure members and said support member, then feeding the bank note to be stored between the first and second pressure members, and, when the bank note to be stored is fed, said processor means commanding the second drive mechanism to displace the second pressure member to the bank note pressing state and the first drive mechanism to temporarily displace the first pressure member positioned between the already stacked bank notes and the immediately fed bank note in a direction away from the stacked bank notes for placing said first member outside the immediately fed bank note, and then commanding the first drive mechanism to displace said first member so as to press all the stacked bank notes.

* * * * *